United States Patent [19]

Malkin et al.

[11] 4,378,957

[45] Apr. 5, 1983

[54] REDUCTION GEAR OF ELECTRONIC WRISTWATCH WITH STEPPING MOTOR AND SWEEP SECOND HAND

[76] Inventors: Daniel D. Malkin, ulitsa Junykh Lenintsev, 95/13, Korpus 1, kv. 31; Alexei V. Simbirtsev, 2 Vokzalny Pereulok 5, kv. 45; Boris A. Peredkov, ulitsa Moldagulovoi 16, Korpus 2, kv. 19; Gennady A. Kruglov, Baltiiskaya ulitsa, 4, kv. 31, all of Moscow, U.S.S.R.

[21] Appl. No.: 195,200

[22] PCT Filed: Apr. 27, 1979

[86] PCT No.: PCT/SU79/00028

§ 371 Date: Apr. 11, 1980

§ 102(e) Date: Apr. 10, 1980

[87] PCT Pub. No.: WO80/00380

PCT Pub. Date: Mar. 6, 1980

[30] Foreign Application Priority Data

Aug. 11, 1978 [SU] U.S.S.R. ..... 2653351

[51] Int. Cl.[3] ..... G04B 37/00

[52] U.S. Cl. ..... 368/300; 368/318; 368/220

[58] Field of Search ..... 368/28, 37, 38, 77, 368/220, 221, 76, 80, 223, 155, 318, 300

[56] References Cited

U.S. PATENT DOCUMENTS 3,888,073 6/1975 Kurita ..... 368/318

3,916,614 11/1975 Takatsuki ..... 368/300

*Primary Examiner*—Bernard Roskoski

*Attorney, Agent, or Firm*—Lilling & Greenspan

[57] ABSTRACT

The reduction gear of an electronic wristwatch comprises three concentric output shafts adapted to be rotated at different speeds and operatively connected with each other and with the shaft of a stepping motor through gear wheels. A shaft making one revolution per hour has mounted thereon a friction wheel and a bearing means made in the form of a supporting bush press fitted in a bore of the plate of the wristwatch. The bush is mounted so that a portion thereof projects from the plate toward the bridge of the wristwatch, coordinated with respect to the plate and attached thereto by threaded means. The shaft passes freely through a bore in the supporting bush and is restricted from an unlimited axial displacement in one direction by an end face of the supporting bush, and in the other direction by the end face of that pinion which is mounted on the shaft with interference fit. The reduction gear of an electronic wristwatch can be used by the watch-making industry in the production of quartz wristwatches having a stepping motor, and of like timepieces.

9 Claims, 3 Drawing Figures

REDUCTION GEAR OF ELECTRONIC WRISTWATCH WITH STEPPING MOTOR AND SWEEP SECOND HAND

FIELD OF INVENTION

The present invention relates to electronic wristwatches having a stepping motor and an analog type of indication, and more particularly it relates to the reduction gear of an electronic wristwatch having a stepping motor and a sweep second.

DESCRIPTION OF THE PRIOR ART

There is known a reduction gear of an electronic wristwatch, /cf. a prospectus No. 850 avialable from Citizen Watch Co Ltd for wristwatch model 85XX/, comprising three concentric output shafts adapted to rotate at different speeds, one of these shafts being adapted to make one full revolution per hour and having mounted threron a friction wheel, the shafts being drivingly connected through gear wheels with one another and with a stepping motor, and a bridge coordinated relative to a plate and secured thereon by threaded means. One of the three concentric shafts carries the second hand, another shaft carries the minute hand, and the third shaft carries the hour hand.

The shaft adapted to make one revolution per hour has one of its bearings arranged in the frame plate while its other bearing is mounted in an auxiliary bridge accommodated in a counterbore provided in the plate on that side thereof which faces the main bridge of the reduction gear. The incorporation of the auxiliary bridge inadvertently results in an increased height of the reduction gear, and, hence, of the entire movement of the timepiece, which is contrary to the present-day trend in making watches of the type being described. The additional counterbore in the plate complicates the manufacture of the plate, and the use of the auxiliary bridge further complicates the assembling of the reduction gear, on account of the necessity of positioning and securing an extra part. Furthermore, the friction torque is produced by two pairs of perpendicular surfaces which are not relatively adjustable, which also substantially complicates the assembling and adjustment of the reduction gear.

There is further known a reduction gear of an electronic wristwatch with analog type of indication, (cf. FRG application No. p 2003045 9-31 published on Jan. 23, 1970, Int. Class G04 C 3/00) comprising three concentric output shafts adapted to rotate at different speeds, of which one shaft is provided with a bearing press-fitted in a bore in the plate and adapted to make one revolution per hour, this shaft carrying a friction wheel; the three shafts being drivingly connected with one another and with the shaft of a stepping motor through gear wheels. The framework of the reduction gear includes a bridge coordindated with respect to the plate and secured thereon by threaded means.

In this known reduction gear the shaft adapted to make one revolution per minute is the last one in the drive chain, which necessitates an additional friction member without which normal operation of the reduction gear is practically impossible. The incorporation of this friction member which is permanently under load adversely affects the efficiency of the reduction gear. Another important feature of this reduction gear is that its gear wheels between the shafts making, respectively, one revolution per hour and one revolution per minute are accommodated in counterbores on both sides of the plate. Consequently, the plate is of a complex configuration, which means that it is labour-consuming to manufacture, and also that it complicates the automation of the process of assembling the reduction gear. Moreover, as the shaft making one revolution per minute has only one bearing, the operation of setting thereon the second hand also becomes complicated.

The closest one to the reduction gear of the present invention is a reduction gear of electronic wristwatch having a stepping motor and a sweep second, disclosed in French application No. 2108200 Cl 04C 3/00. This reduction gear comprises three concentric output shafts adapted to rotate at different speeds, one of the shafts being provided with a bearing in the form of a supporting bush press-fitted in a bore in the plate, this shaft making one revolution per hour and having mounted thereon a friction wheel; the three shafts being drivingly connected to one another and to the shaft of a motor through gear wheels; the reduction gear further including a bridge coordinated with respect to the plate and secured thereon by threaded means.

Same as in the two abovedescribed types of the reduction gear, in the last-mentioned reduction gear the plate has complex counterbores and milled areas on both sides, which makes its manufacture labour-consuming; besides, the unadjustable friction member complicates the assembling of the reduction gear its adjustment and repair. Moreover, the reduction gear comprises an auxiliary bridge for one of the bearings of an intermediate shaft, accommodated in a counterbore of the plate on its dial-facing side, which complicates the assembling and adjustments of the reduction gear still further.

Thus, among the common features of the above three types of the reduction gear is the structural intricacy of the plate which accounts for up to 50 percent of the total labour consumed in the manufacture and assembling of the reduction gear, and this affects the effectiveness of the production technology; in addition with the friction coupling being unadjustable, the manufacture and assembling of the reduction gear becomes complicated, particularly, when thin wristwatches are manufactured.

SUMMARY OF THE INVENTION

It is an object of the present invention to create a reduction gear of an electronic wristwatch having a stepping motor and a sweep second wherein the structure of the shaft support, accommodated in the wristwatch plate, with the shaft making one revolution per hour, provides higher production technology and simplicity in assembling, as well as reduction of its overall height.

This object is attained by a reduction gear of an electronic wristwatch having a stepping motor and a sweep second, comprising three concentric output shafts adapted to rotate at different speeds. One of the shafts is provided with a bearing in the form of a supporting bush press-fitted in a bore in a plate, this shaft being adapted to make one revolution per hour and to carry a friction wheel. The shafts are drivingly connected to one another and to the shaft of the motor through gear wheels and a bridge coordinated with respect to the plate and secured thereon by threaded means. This reduction gear, in accordance with the present invention, has the shaft adapted to make one revolution per hour freely passing through a bore in the supporting bush, the supporting bush being press-fitted in the bore of the plate so that a portion thereof projects from the plate toward the bridge, said shaft being prevented from unlimited axial displacement in one direction by an end face of the supporting bush and in the other direction by an end face of that gear wheel which is mounted on this shaft with an interference fit.

It is expedient that the portion of the supporting bush, projecting from the plate, should be accommodated in a counterbore provided in a flange of the shaft freely passing through the bore of the supporting bush.

It is further expedient that the friction wheel should be located in a plane extending intermediate that end face of the supporting bush, which projects from the plate, and the other end face thereof.

It is further expedient that the friction wheel should be mounted for free rotation on the flange of the shaft freely passing through the bore in the supporting bush, and should be adapted for friction engagement with respective parallel end faces of two elements coaxial with the shaft, these faces facing each other.

It is still further expedient that one of said two elements should be a split bush mounted with an interference fit on the flange on the shaft, and that the other element should be an annular shoulder provided on the flange of the shaft.

It is still further expedient that the gear wheels through which the shaft of the stepping motor is operatively connected with the shaft freely passing through the bore of the supporting bush should be arranged that side of the plate, which faces the bridge.

It is also expedient that in a reduction gear wherein the shaft adapted to make one revolution per minute is mounted in bearings, in accordance with a preferred embodiment of the invention, this shaft should pass through a bore in the shaft freely passing through the bore in the supporting bush.

It is preferable that the supporting bush press-fitted in the bore of the plate be coordinated with respect to the bridge by at least two threaded studs attaching the bridge to the plate.

It is also expedient that each of the studs should have a distance between two most remote points on its end face surface, coordinating the plate, at least equal to the spacing of the geometric axes of any two adjacent shafts.

If the shaft adapted to make one revolution per hour freely passes through the bore in the bush press-fitted in the plate on its bridge-facing side, this shaft can be put in place while assembling the reduction gear, likewise from the side of the bridge, whereby the entire gearing between this shaft and the shaft adapted to make one revolution per minute may be arranged on one side of the plate, facing the bridge. This enables to do without several complex counterbores and milled areas in the plate, i.e. to simplify both the structure of the plate and its manufacture. The coordination and securing of the bridge on the plate by two or more threaded studs makes the above advantageous feature even more obvious.

The restriction of axial play of the shaft adapted to make one revolution per hour is effected in the herein disclosed reduction gear in the simplest way possible, with only two dimensions defining the degree of its play, which yields substantial labour saving in the assembling of the reduction gear. The adjustability of the friction member makes this advantageous feature more pronounced. At the same time, the structure of the entire assembly of output shafts enables significantly reduction of the overall height of the reduction gear.

BRIEF DESCRIPTION OF DRAWINGS

The invention will be further described in connection with its preferred embodiments, reference being made to the accompanying drawings, wherein.

PREFERRED EMBODIMENTS OF THE INVENTION

Figure 1:
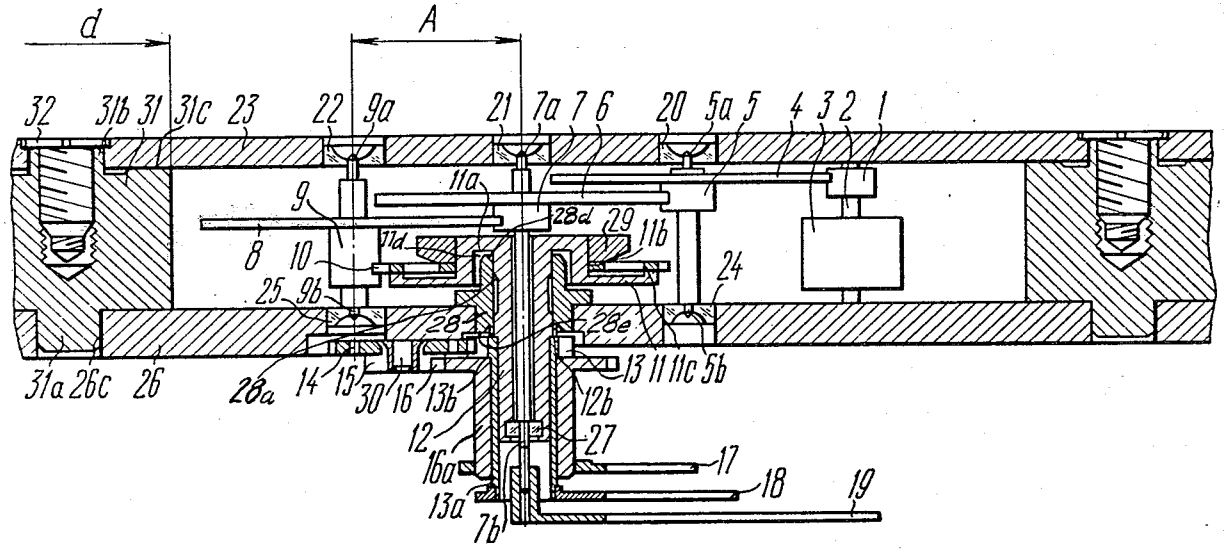
FIG. 1 is a longitudinal section of a reduction gear of an electronic wristwatch having a stepping motor and a sweep second embodying the invention.

In the drawings, the reduction gear of an electronic wristwatch having a stepping motor and a sweep second includes a pinion 1 (FIG. 1) mounted on a shaft 2 of a stepping motor 3, this shaft 2 being the input shaft of the reduction gear. The pinion 1 meshes with an idler 4 fitted on a shaft with a pinion 5 which, in turn, meshes with a second gear 6. The gear 6 is fitted on a shaft of the central or sweep second pinion 7 adapted to make one revolution per minute and meshing with an idler 8. The idler 8 is fitted on the shaft of a pinion 9 which meshes with a central friction wheel 10, the friction wheel 10 being received for free rotation on a flange 11.

Figure 2:
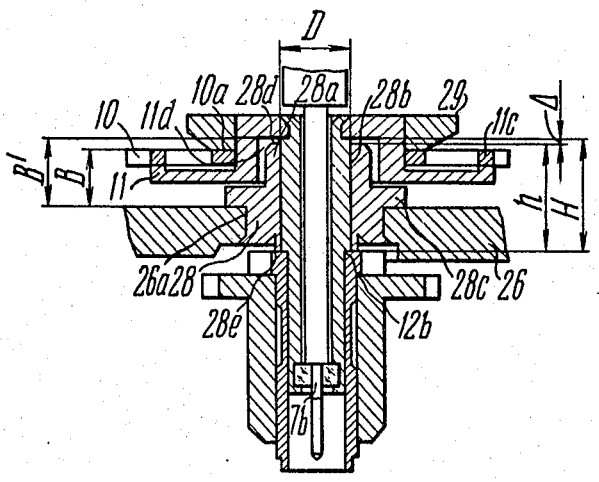
FIG. 2 is an enlarged longitudinal section of a reduction gear shaft assembly, with the shaft adapted to make one revolution per hour having an integral flange.
Figure 3:
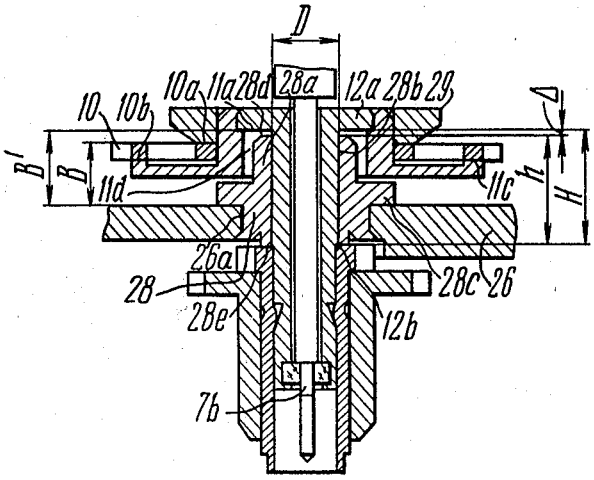
FIG. 3 is a view similar to FIG. 2, but with a composite flange of the shaft adapted to make one revolution per hour.

The flange 11 is mounted with interference fit on a hollow shaft 12 adapted to make one revolution per hour. In the embodiment illustrated in FIG. 2 the flange 11 is an integral part mounted on a reduced-diameter portion of the shaft 12. In the embodiment illustrated in FIG. 3 the flange 11 is of a composite structure. In this embodiment the flange 11 is defined by a cylindrical shoulder **12*a* of the shaft 12 and an L-shaped part, press-fitted on this shoulder 12*a*. Alternatively, the flange 11 can be fully integral with the shaft 12, as it is shown in FIG. 1. In any case, the flange 11 has an inner end face 11*a* adapted to restrict the axial play of the shaft 12**.

Made in the outer or external surface of the flange 11 is an L-shaped groove defining two perpendicular surfaces, i.e. a cylindrical surface **11*b* and the face surface of an annular abutment 11*c* of the flange 11. The former of the two surfaces supports the wheel 10 radially, and the latter supports it axially. The end of the hollow shaft 12, projecting towards the dial (not shown), has mounted thereon a driver cannon pinion 13 abutting against a shoulder 12*b* and meshing with a minute wheel 14. The minute wheel is fitted on a pinion 15 meshing with an hour wheel 16. The hour wheel is integral with a hollow shaft 16*a* adapted to make one revolution in twelve hours and carrying an hour hand 17. The bush 13*a* of the driver cannon pinion 13 carries a minute hand 18; and the end of the elongated lower journal of the shaft of the central second pinion 7 passing through the hollow shaft 12 carries a second hand 19. Thus, the shaft of the central second pinion 7 and the hollow shafts 12 and 16*a*, concentric therewith, are the three output shafts of the reduction gear, adapted to rotate at different speeds and connected operatively with one another and with the shaft 2 of the stepping motor 3 through gear wheels. The upper journal 5*a* of the pinion 5, the upper journal 7*a* of the pinion 7** and the upper journal 9a of the pinion 9 are supported, respectively, in jewel bearings 20, 21 and 22 press-fitted in the respective bores of a bridge 23 of the reduction gear. The lower journal 5b of the pinion 5 and the lower journal 9b of the pinion 9 are respectively supported in jewel bearings 24 and 25 press-fitted in the respective bores in a plate 26; and the lower journal 7b of the pinion 7 is supported in a jewel bearing 27 press-fitted in the bore of the shaft 12.

Press-fitted in the central bore 26a of the plate 26 (FIG. 3) is a bush 28 acting as a bearing for the shaft 12 which freely passes through the bore of the bush 28. The elongated portion 28a of the bush 28 projects from the plate 26 toward the bridge 23 so that the inner cylindrical surface 28b of the bush 28, acting as a radial bearing for the shaft 12, is sufficiently developed in the axial direction. It is preferable that the height "h" of the bush 28 should be at least equal to the external diameter "D" of the shaft 12.

The bush 28 has a radial shoulder 28c engaging the plate 26, which prevents incidental withdrawal of the bush 28 when the minute pinion 13 is removed in the course of disassembling the reduction gear, e.g. during repairs of the watch. The elongated cylindrical portion 28a of the bush 28 is accommodated in an internal counterbore 11d of the flange 11, the upper end face 28d of the bush 28 serving as the axial bearing of the hollow shaft 12, and the lower end face 28e thereof acting as the axial bearing of the pinion 13; and, with the pinion 13 being mounted on the shaft 12 with interference fit, the end face 28e of the bush 28 is, in fact, an axial bearing of the shaft 12. Therefore, the value Δ of the axial play of the shaft 12 and, hence of the central wheel 10 and of the driver cannon pinion 13 is defined by manufacturing tolerances of but two dimensions, viz. the height "h" of the bush 28 and the spacing H between the end face 11a of the flange 11 and the shoulder 12b of the shaft 12.

Mounted with interference fit onto the cylindrical surface 11b of the flange 11 is a split bush 29 adapted for friction engagement with the upper face 10a of the central friction wheel 10 of which the lower face 10b is adapted for friction engagement with the end face of the angular abutment 11c of the flange 11, which is parallel with the end face of the bush 29. By an axial adjustment of the split bush 29, it is possible to vary the deflection of the central friction wheel 10, and thus to adjust the value of the friction torque.

The wheel 10 has its upper face 10a spaced from the plate 26 by a distance B which is equal to or less than the spacing B' of the plate 26 from the upper face 28d of the bush 28. Preferably, B<B' (see FIG. 3) which is attained by the upper portion 28a of the bush 28 being received in the inner counterbore 11d of the flange 11, and the wheel 10 being positioned on the external L-shaped groove of the flange 11. Thus, the wheel 10 is in a plane extending intermediate the end faces of the bush 28, i.e. within the bearing, and the radial force between idler pinion 9 and central friction wheel 10 is applied intermediate the bearing or support surfaces of the shaft 12. The bearing surfaces of the shaft 16a of the hour wheel 16 are the outer cylindrical surface of the bush 13a of the driver cannon pinion 13 and its face 13b, and also the side of a dial (not shown), facing the plate 26. The radial bearing of the shaft of the minute pinion 15 is a pin 30 tightly fitted in a bore in the plate 26; the upper axial bearing of this pinion 15 is the plate 26 proper, while its lower axial bearing is either a cock (not shown), or the plate of the calendar (not shown).

As it can be seen in FIG. 1, the plate 26 has neither counterbores nor milled areas on its side facing the bridge 23. Made in the plate 26 on this side are only bores 26c each having fitted therein a cylindrical projection 31a of a threaded stud 31, i.e. a stud having a threaded bore, the other cylindrical projection 31b of this stud 31 serving for coordinating or positioning the bridge 23 on the end face of this projection. The spacing "d" between any two most remote points of the bridge positioning end face 31c of the stud 31 is substantially equal to the spacing A between the geometric axes of any two adjacent shafts of the reduction gear, as it is shown in FIG. 1, e.g. the shafts of the pinion 9 and pinion 7. Preferably, $\alpha < A$.

The stud 31, preferably, is circular in plan view. However, in practical embodiments of the invention, this shape may be different, e.g. oval, square, triangual, etc.

There may be any number of threaded studs 31, but not less than two. It is preferable that two studs should be incorporated, because in this case the required accuracy of coordinating the bridge 23 with respect to the plate 26 is attained in the simplest way.

The bridge 23 rests on the upper end faces 31c of the studs 31 and has its bores received on the respective projections 31b of studs 31, the bridge 23 being fastened to these studs 31 by screws 32, in which manner the bridge 23 is coordinated or positioned with respect to the plate 26.

The jewel bearings 20, 21 and 22 in the bridge 23 and the jewel bearings 24 and 25 in the plate 26 are preferably press fitted, flush with the respective surfaces of the bridge 23 and plate 26, facing each other.

The bearings 20, 21, 22, 24 and 25 of the embodiment, illustrated in FIG. 1, are of jewel bearing type; however, they may be of different type and materials, e.g. of the self-lubricating type; it is also possible that gauged bores proper in the plate 26 and in the bridge 23 may serve as bearings.

The operation of the reduction gear of an electronic-watch having a stepping motor and sweep second, embodying the invention, is obvious to those skilled in the art.

Industrial Applicability

The reduction gear of an electronic wristwatch having a stepping motor and a sweep second can be most effectively used by the watch-making industry in the production of guartz wristwatches with a stepping motor, and of like timepieces.

What we claim is:

1. A reduction gear of an electronic wristwatch having a stepping motor and a sweep second, comprising three concentric output shafts rotating at different speeds, a first one of the shafts being provided with a bearing in the form of a supporting bush press-fitted in a bore in a wristwatch plate, said first shaft making one revolution per hour and supporting a friction wheel, the shafts being drivingly connected to one another and to a shaft of the stepping motor through gear wheels and a bridge coordinated with respect to the plate and secured thereon by threaded means, wherein the improvement comprises the first shaft freely passing through a bore provided in the supporting bush, the supporting bush being press-fitted in the bore of the plate so that a portion of said supporting bush projects from the plate towards the bridge, said shaft being prevented from unlimited axial displacement in one direction by the end face of the supporting bush and in the other direction by the end face of a gear wheel which is mounted on said first shaft with an interference fit.

2. A reduction gear according to claim 1, wherein the portion of the supporting bush projecting from the plate is accommodated in a counterbore provided in a flange of the shaft freely passing through the bore of the supporting bush.

3. A reduction gear according to claim 1, wherein the friction wheel is located in a plate extending intermediate an end face of the supporting bush which projects from the plate and the other end face.

4. A reduction gear according to claim 1 wherein the friction wheel is mounted for free rotation on the flange of the shaft freely passing through the bore in the supporting bush and is in friction engagement with respective parallel end faces of two elements coaxial with the shaft, these faces facing each other.

5. A reduction gear according to claim 4, wherein one of said elements is a split bush mounted with an interference fit on the flange of the shaft, the other element is an annular shoulder provided on the flange of the shaft.

6. A reduction gear according to claim 1 wherein the gear wheels, through which the shaft of the stepping motor is operatively connected with the shaft freely passing through the bore of the supporting bush, are arranged on that side of the plate facing the bridge.

7. A reduction gear according to claim 1 wherein the first shaft is mounted in bearings, one of the bearings of the first shaft being located in the bore of the shaft freely passing through the bore in the supporting bush.

8. A reduction gear according to claim 1 wherein the supporting bush press-fitted in the bore of the plate is coordinated with respect to the bridge by at least two threaded studs attaching the bridge to the plate.

9. A reduction gear according to claim 8, wherein each of the studs has a distance between the two most remote points on its end face surface coordinating the plate at least equal to the spacing of the geometric axes of any two adjacent shafts of the gears.

* * * * *